United States Patent [19]

Guergen

[11] 4,294,319

[45] Oct. 13, 1981

[54] CUTTER HEAD FOR ROTARY PERCUSSION DRILLS

[76] Inventor: Karlheinz Guergen, Elsterkamp 3, 2110 Buchholz, Nordheide, Fed. Rep. of Germany

[21] Appl. No.: 33,305

[22] Filed: Apr. 25, 1979

[30] Foreign Application Priority Data

May 16, 1978 [DE] Fed. Rep. of Germany ..... 2821248
Sep. 25, 1978 [DE] Fed. Rep. of Germany ..... 2841679

[51] Int. Cl.[3] ..... E21B 9/02

[52] U.S. Cl. ..... 175/389; 175/398; 175/410; 175/415

[58] Field of Search ..... 175/319, 381, 385, 389, 175/390, 391, 395, 398, 400, 405, 407, 409–415, 417–420

[56] References Cited

U.S. PATENT DOCUMENTS

| | | | |
|---|---|---|---|
| 1,083,666 | 1/1914 | Cook | 175/415 |
| 2,461,305 | 2/1949 | Winn | 175/410 X |
| 2,696,973 | 12/1954 | Baumgartner | 175/415 |
| 2,759,705 | 8/1956 | Bjorkman | 175/389 |
| 3,163,246 | 12/1964 | Vagins et al. | 175/410 |
| 3,297,101 | 1/1967 | Wohlmeyer | 175/415 |
| 3,299,974 | 1/1967 | Clemmow | 175/410 |
| 3,469,641 | 9/1969 | Reynolds | 175/389 |
| 4,026,372 | 5/1977 | Hampson | 175/410 |

*Primary Examiner*—James A. Leppink
*Attorney, Agent, or Firm*—Cooper, Dunham, Clark, Griffin & Moran

[57] ABSTRACT

A replaceable cutter head for rotary percussion drills having a pilot cutter on the end of a drill stem with a main cutter head surrounding the pilot cutter, the main cutter head having hammering/chipping cutters and milling cutters arranged along radial lines extending from the pilot cutter to the outer periphery of the main cutter head in alternate arrays, either along the radial cutter lines or on alternate radial cutter lines, or both.

5 Claims, 14 Drawing Figures

Fig.1
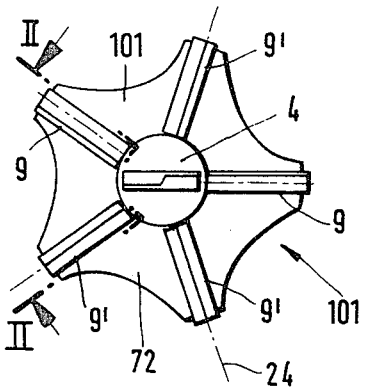
Fig.3
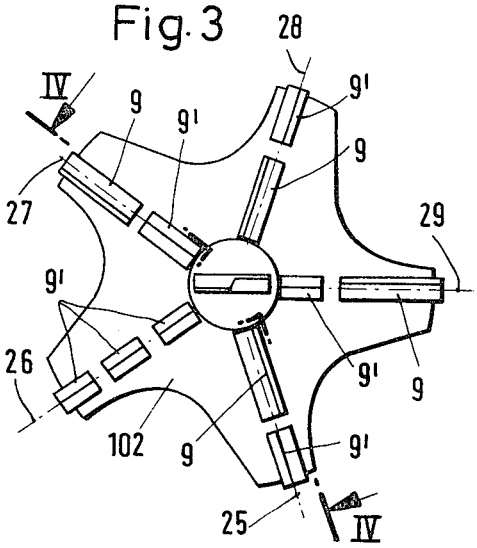
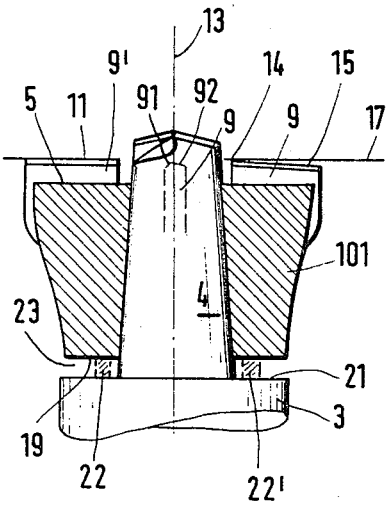
Fig.2
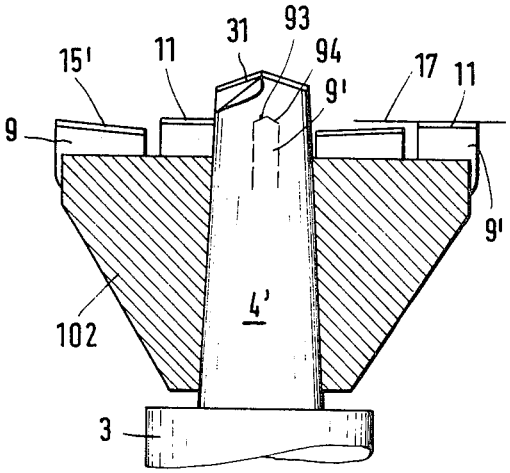
Fig.4

CUTTER HEAD FOR ROTARY PERCUSSION DRILLS

This invention relates to a replaceable cutter head for rotary percussion drills and hammer drills useable in all types of rock, which is designed to be frictionally held to a drill stem, in which the main cutters are set back relative to a pilot bit or fore-cutter provided on the head of the drill stem and in which cutting edges of the main cutters are arranged radially outward from the pilot bit.

One such cutter head is known, for example, from German Pat. No. 967,491 (U.S. Pat. No. 2,159,705). The rotary percussion drill according to this patent consists of a drill stem and a cutter head which is wedged onto a drill stem. To this end, the drill stem is provided with an outer cone on which the cutter head is seated with its matching inner cone. At its front end, the drill stem comprises a fore-cutter or pilot bit which projects beyond the cutters of the cutter head. Four radial rows of cutters are provided on the cutter head arranged in the shape of a cross, the cutting edges being inclined outward and away from the drilling direction. Between the cutting zone of the pilot cutter and the cutting zone of the cutters of the main cutter head, there is a gap in the region of which a ring of rock is formed when the drill is in operation.

Although it is known that the ring of rock formed between the fore-cutter and the cutters of the cutter head is eliminated by rubbing or disintegration as the drill advances, this rubbing, crushing and disintegration generates a considerable amount of heat and, hence, involves a high power consumption. This unnecessary power consumption is considerably increased in cases where it is intended to drill fairly large diameters with the drill.

The rock drill according to German Pat. No. 967,491 is a rotary percussion drill. In a percussion drill of this type, all the cutters of the cutter head have a chisel-like cutting edge which gives rise to the disadvantage that the drill requires a relatively high power input.

A principal object of the present invention is to provide a replaceable cutter head for a rock drill which may be used for a wide range of bore diameters and, in particular, for large bore diameters, for example, of up to 150 mm, for reasonable power inputs and reasonable drill-stem diameters.

In a replaceable cutter head of the type referred to hereinabove, this object is achieved in accordance with the invention in that cutters designed for milling and cutters designed for hammering are distributed along the radial cutter lines in the cutter head.

A replaceable cutter head as disclosed herein has the advantage that, for a reasonable power input, it is even possible to drill bore holes with a diameter of up to 150 mm. Despite this large bore hole diameter, the drill stems used remain relatively thin because the cutter head has an extremely high cutting capacity for a reasonable power input.

In another embodiment of the cutter head of this invention, milling cutters and hammering/chipping cutters are alternated so that rock is successively hammered or chipped (which is the same in terms of effect) and milled. In accordance with another aspect of this invention, one or more milling cutters and one or more hammering/chipping cutters are also alternately arranged along a radial cutter line.

In another embodiment of the invention, the innermost cutter of a radial cutter line immediately adjoins and is aligned with a pilot bit cutter, also termed fore-cutter. This arrangement ensures that no ring rock is left between the pilot bit and the main cutter head.

In another embodiment of the invention, cutters are arranged in the radial cutter lines of the main cutter head so that gaps between the cutters of one cutter line are bridged by cutters arranged on one or more cutter lines following it in a rotational direction. This arrangement also prevents the formation of a ring of uncut rock.

In still another embodiment of the invention, the cutting edges of the hammering/chipping cutters fall into a radial plane parallel to the plane of the cutter head and perpendicular to the axis of the drill stem of the cutter head while the milling cutters may be associated either in such a way that the projecting tips of the cutting edges of the milling cutters fall into the same plane as the edges of the hammering/chipping cutters or in such a way that the cutting edges of the hammering/chipping cutters project approximately 1 to 3 mm, preferably about 2 mm, beyond the tips of the milling cutters. In this embodiment, the hammering/chipping cutters are the first to act on the rock to be drilled and have the effect of loosening it. The milling cutters which follow behind the hammering cutters then cut through the loosened rock. The double effect of hammering and milling results in fast cutting speeds and a considerable reduction in the power required to drive the drill.

In accordance with the present invention, three or more cutter lines are provided in the main cutter head. In a cutter head having only three cutter lines, either two hammering/chipping and one milling cutter or two milling cutters and one hammering/chipping cutter are arranged on the cutter lines. A cutter head of this type is intended for small bore diameters. As the bore diameter increases, the number of cutter lines and the number of cutters per cutter line also increase commensurately.

In a still further embodiment of this invention, intermediate cutters are arranged on the face of the cutter head between radial lines of the milling cutters and hammering/chipping cutters. These intermediate cutters may be both milling cutters and also hammering/chipping cutters and are preferably arranged in such a way that they bridge the gaps between the leading main cutters. The intermediate cutters follow the main cutters in the direction of rotation of the cutter head, lagging the main cutters by a rotational angle of 20° to 40°, preferably about 30°.

It is possible to work with different cutter forms. Thus, in another embodiment of the invention, the hammering/chipping cutters are shorter than the milling cutters. In this case, the cutting edges of the hammering/chipping cutters are situated in the above-mentioned plane. The milling cutters may slope outwards away from the direction of drilling or inward and away from the drilling direction. Alternatively, the cutting edges of the milling cutters may be in the form of a chevron or "roof-like" form, in which case the point of the cutter has a hammering effect and the sloping edges of the cutter, a milling effect.

The outer cutters are preferably provided with a relief angle formed by an undercut in order to make it easier for the cutter head to run freely in the bore hole.

The shaping of hammering/chipping cutters on the one hand and milling cutters on the other hand is known per se. Thus, the hammering/chipping cutters have a cutting edge in which the leading edge or "run-on surface" and the trailing edge or "run-off surface" are inclined in substantially the same way, i.e., at substantially the same angle. By contrast, the milling cutters have a relatively steep run-on surface and a relatively flat run-off surface. The angle of inclination of the cutting edges of the milling cutters is of the order of 5° to 10°, preferably about 7°.

Between the cutter lines, the body of the cutter head is cut away or recessed from outside in the form of deeply penetrating curves. By the placement of the intermediate cutters behind the leading milling cutters, in the direction of rotation, the following milling cutters find a working zone cleared of rock dust. This is because the dust from the previously drilled rock is pushed away by the intermediate cutters into the lateral recesses in the cutter head through which the rock dust may be removed rearwards. This removal of rock dust may be additionally assisted by applying suction.

According to another aspect of the invention, a lateral space is left free between the base or drill-stem end of the cutter head and the shoulder of the actual drill stem for accommodating an ejector.

Finally, the pilot bit and fore-cutter may also be replaceable to enable the drill stem to be kept in use for longer periods. In this case, a lateral space is also left free between the body or collar of the pilot bit and replaceable fore-cutter and the front end of the drill stem for accommodating an ejector.

Preferred embodiments of the invention are described by way of example in the following detailed description with reference to the accompanying drawings, the hammering/chipping cutters being referred to throughout solely as hammering cutters because both terms characterize cutters which have the same structure and the same effect.

FIGS. 1 and 2 are, respectively, a plan view of and a section through a cutter head having five radial cutter lines with the drill stem inserted, hammering cutters and milling cutters alternating in the cutter head.

FIGS. 3 and 4 show a modification of the cutter head illustrated in FIGS. 1 and 2 in which hammering cutters and milling cutters have been divided up and interchanged along the individual cutter lines.

Figure 5:
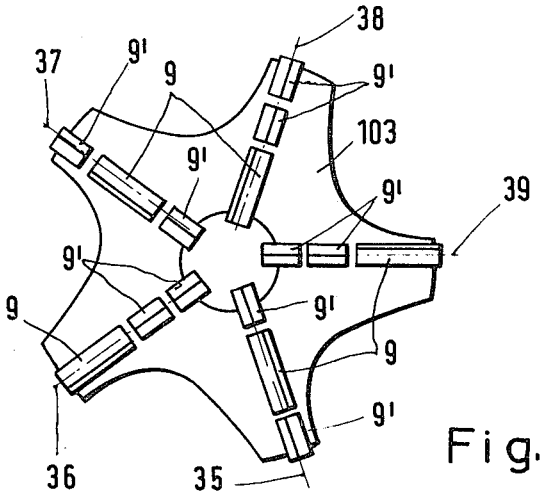
FIGS. 5 and 6 show another embodiment with five cutter lines, several cutters per cutter line (the cutters again alternating with one another) and a replaceable pilot bit and fore-cutter.

Cutter lines are understood to be lines along which the chipping and milling cutters extend outwards from the pilot bit or fore-cutter. These lines may coincide with radials and may form stars, crosses or other shapes obtained by angular distribution. The cutting edges, particularly of the milling cutters, may be laterally offset relative to these lines.

FIG. 1 shows a replaceable cutter head 101 for a rotary percussion drill or hammer drill which, through a conical central opening, is seated by wedge effect on a conical portion of an associated drill stem 3 which may comprise an integral or replaceable pilot bit or fore-cutter 4. Cutters 9 and 9' are arranged on the face 5 of the cutter head 101 along radial cutter lines 7 situated at equal angular intervals. The cutters 9 are in the form of milling cutters whilst the cutters 9' are in the form of hammering cutters. The milling cutters 9 have a relatively steep leading edge or run-on surface 91 and a relatively flat trailing edge or run-off surface 92 (FIG. 2). By contrast, the hammering cutters 9' have a cutting edge in which the leading edge or run-on surface 93 and the trailing edge or run-off surface 94 rise and fall at substantially equal angles (FIG. 4).

FIG. 2 is a section on the line II—II through the cutter head shown in FIG. 1. The section extends along the surface of a hammering cutter 9' around the seat for the pilot bit or fore-cutter and then continues along a milling cutter 9. It can be seen from FIG. 2 that the hammering cutter 9' shown on the left-hand side is arranged radially and, hence, perpendicularly of the drilling direction with its upper cutting edges 11, the drilling direction coinciding with the axis 13 of the system. All the hammering cutters 9' have this orientation and, hence, fall into radial plane 17 parallel to the face of the cutter head and perpendicular to the axis of the drill stem. The milling cutter 9 shown on the right-hand side of FIG. 2 has an outwardly sloping cutting edge 15, the slope running away from plane 17 against the drilling direction. The highest point 14 of the cutting edge 15 is situated as close as possible to the pilot bit fore-cutter 4 and is set back slightly, i.e., by 1 to 3 mm, preferably about 2 mm, relative to the plane 17 coinciding with the cutting edge 11 of the hammering cutter 9' in the drilling direction.

A gap 23 is left between the lower edge 19 of the cutter head 101 and the shoulder or front edge 21 of the drill stem 3. The function of this gap 23 is to receive the ejector 4 indicated with its arms 22, 22' between the drill stem 3 and the cutter head 101 and, hence, to enable the cutter head 101 to be loosened.

In the embodiment illustrated in FIGS. 1 and 2, there are five radial cutter lines 24 along which the milling and hammering cutters extend. However, it is of course also possible to increase or reduce the number of cutter lines. The lowest advisable number of cutter lines is about three, while five cutter lines are favorable, particularly for large cutter heads.

Between the individual cutter lines 24, the cutter head 101 is provided from outside with peripheral recesses 72 through which the rock dust generated during drilling may be more readily removed.

The embodiment illustrated in FIGS. 3 and 4 is again based on a cutter head 102 having five radial cutter lines 25 to 29 arranged at equal angular intervals. The section IV—IV shown in FIG. 4 extends along the cutters 9', 9 on one cutter line 25 around the shank of the drill stem 4 comprising a pilot bit or fore-cutter and then continues along the cutters 9, 9' of another cutter line 27. On the cutter lines shown in FIGS. 3 and 4, milling cutters and hammering cutters alternate in the rotational direction from one cutter line to the other. The milling cutters 9 are wider (longer in the axial direction) then the hammering cutters. In addition, milling cutters (9) and hammering cutters (9') are mixed with one another along the individual cutter lines. On the cutter line 25, a milling cutter 9 is followed from inside to the outside end of the line by a hammering cutter 9'. On the cutter line 26, there are three hammering cutters 9' adjacent one another. On the cutter line 27, a hammering cutter 9' is followed by a milling cutter 9, while cutter line 28 comprises, from inside to outside, a milling cutter 9 and a hammering cutter 9' on the inside and a milling cutter 9 on the outside.

As in FIGS. 1 and 2, the cutting edges 31 of the pilot bit fore-cutter 4' project centrally beyond the plane 17 which coincides with the cutting edges 11 of the hammering cutters 9' and which represents the foremost working surface. In this embodiment, the cutting edges 15' of the milling cutters 9 are sloped relative to the plane 17, approaching the plane at their outer edges.

Figure 6:
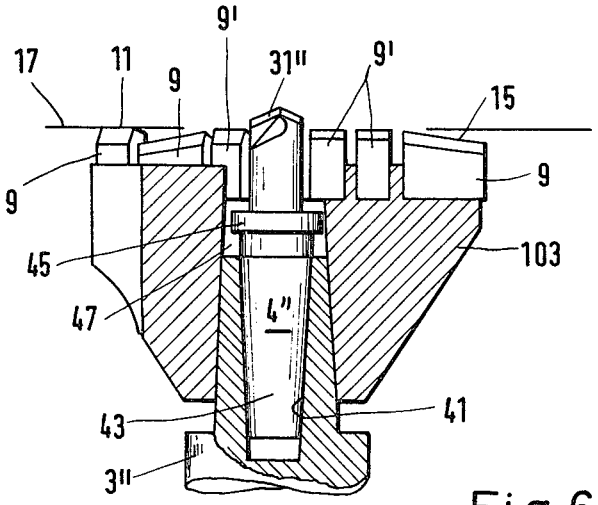

FIGS. 5 and 6 show a somewhat different section through a cutter head 103 which is also equipped with several cutters per cutter line in order to cover the space between the central pilot bit fore-cutter 4'', its cutting edges 31'' and the outside of the cutter head 103. In this case also, the cutter head 103 is provided with five cutter lines arranged at equal angular intervals from one another. The cutter line 35 comprises, from inside to outside, a hammering cutter 9', a milling cutter 9 and another hammering cutter 9'. The adjacent cutter line 36 comprises, from inside to outside, two hammering cutters 9' followed by a milling cutter 9. The cutter line 37 comprises, from inside to outside, a hammering cutter 9', a milling cutter 9 and another hammering cutter 9'. The cutter line 38 has a milling cutter 9 on the inside and two hammering cutters 9' on the outside. Finally, the cutter line 39 has two hammering cutters 9' on the inside and a milling cutter 9 on the outside.

FIG. 6 shows that the cutting edges 11 of the hammering cutters 9' again coincide with the plane 17, while the cutting edges 15 of the milling cutters are inclined outward and rearward. In one particular modification of the drill stem which is shown in FIG. 6, the drill stem 3'' is provided at its upper end with a conical recess 41 for a correspondingly shaped stem 43 of the pilot bit 4'' which, in this case, is replaceable. The pilot cutter 4'' is provided at a distance from the front end of its stem 43 with a body or collar 45 to enable an ejector to be inserted into the space 47 thus formed. Although not shown, this ejector may correspond to that indicated in FIG. 2.

Figure 7:
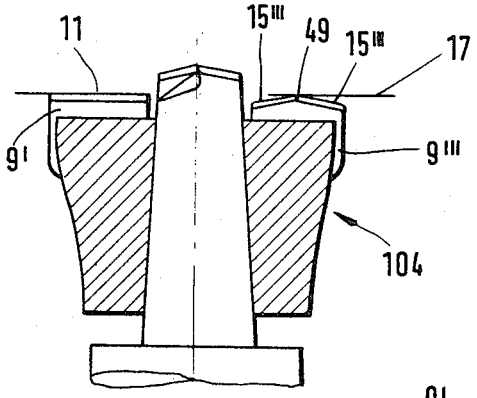
FIG. 7 shows an embodiment in which the milling cutters have a chevron or roof-like form and are intended both for hammering and also for milling.

FIG. 7 shows a modification of the embodiment illustrated in FIGS. 1 and 2. In this modified cutter head 104, the outwardly sloping cutting edge 15 of the milling cutter 9 shown in FIG. 1 is replaced by a chevron shaped or roof-like cutter 9'''. The point or ridge 49 of the chevron or roof-like cutter 9''' falls into the plane 17 into which the cutting edge 11 of the hammering cutter 9' also falls. From the point 49, the edges 15''' slope away to both sides. In this case, the point 49 acts as a hammer, while the sloping edges 15''' are ground as milling cutters and act accordingly.

Figure 8:
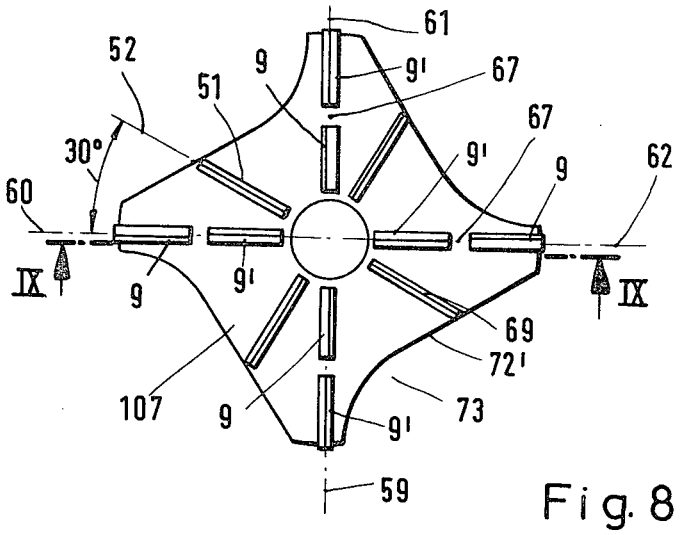
FIGS. 8 and 9 show an embodiment with four main cutter lines and intermediate cutters arranged between main cutter lines.
Figure 9:
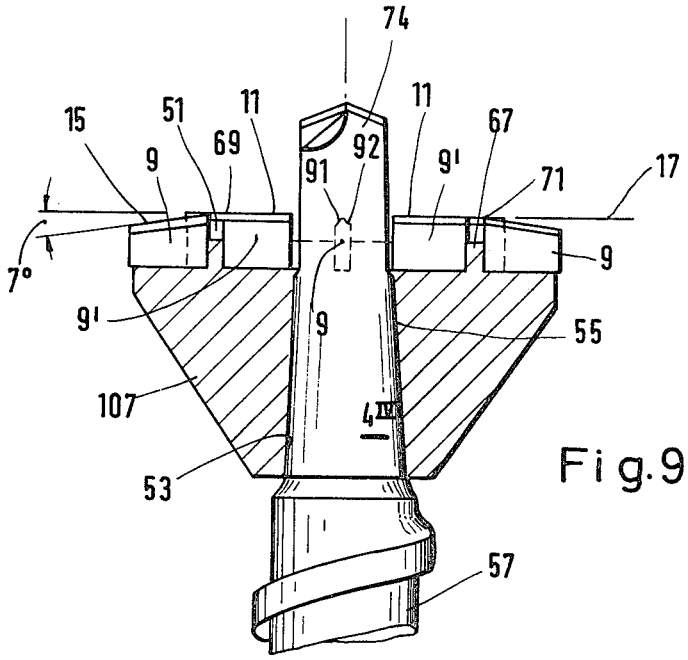

In FIGS. 8 and 9, a replaceable cutter head 107 is provided with four cutter lines 59–62 and, in addition, with intermediate cutters 51 on intermediate cutter lines 52. The intermediate cutters 51 may be both in the form of milling cutters and in the form of hammering cutters. The cutter head 107 is again centrally provided with a conical recess 53 which is designed to be seated by wedge effect on a corresponding frustoconical neck 55 of a drill stem 57. In this case, the cutter lines 59–62 together form a cross. On the cutter lines, a hammering cutter 9 and a milling cutter 9' always alternate with one another from inside to outside.

The cutting edges 15 of the milling cutters 9 are inclined to slope outwards and away from plane 17 against the drilling direction at an angle of 5° to 10°, preferably for example about 7°. As milling edges, the cutting edges 15 have a relatively steep leading edge or run-on surface and a relatively flat trailing edge or run-off surface.

The intermediate cutters 51 extend radially between the main cutter lines and have a radial dimension which is gauged in such a way that they bridge the cutters 9 and 9' and the gaps 67 between them.

Like the cutting edges 11 of the hammering cutter 9', the cutting edges 69 of the intermediate cutters 51 fall into the plane 17. In addition, the front tips 71 of the milling cutters 9 are set back slightly behind the plane 17 in the drilling direction. This in turn means that the hammering cutters are the first cutters to come into operation during drilling, the milling cutters subsequently cutting through the material loosened by the hammering cutters. Since the intermediate cutters 51 bridge the intermediate spaces 67 between the cutters on the cutter lines, there is no untreated gap over the entire width of the drilling surface. Accordingly, there are also no residues to be subsequently removed by rubbing or to produce undesired friction. Accordingly, this staggered array of cutters is useful in all cutter heads.

FIG. 8 shows how the cutter head 107 is recessed by removing parts of the peripheral portion of the cutter head 107 between the individual cutter lines 59 to 62. As a result of this recessing, the peripheral boundary of these recesses 72' is delimited by curves penetrating deeply from outside. The recesses 72' form openings for the removal of the rock material which is generated during drilling. The removal of this rock material may be further improved, for example, by applying suction to draw air and rock dust away from the cutter head area.

During rotation of the cutter head 107, the intermediate cutters 51 extend at an angle of 20° to 40°, preferably about 30°, behind the leading cutters. The deepest points 73 of the recesses 72' are situated between the intermediate cutter lines 52 and the following cutter lines 59–62. Accordingly, the intermediate cutters 51 on the intermediate cutter lines 52 perform a second important function which is to sweep away the cut rock which has not yet fallen into the recesses 72' from the working surface on the cutter head 107 into the recesses 72'. As a result, the following milling cutters encounter a clean surface and are able to work more effectively.

When the cutter head 107 is in position, the neck of the drill stem 57 projects through the main cutter head with the head 74 of its pilot bit fore-cutter 4. The pilot bit head 74 also projects beyond the plane 17, which represents the foremost working plane of the main cutter head 107, and is thus able to take over guiding of the drill.

The rear part of the drill stem 57 is provided in the usual way with a spiral to enable the rock which has been cut away to be removed more easily.

Figure 11:
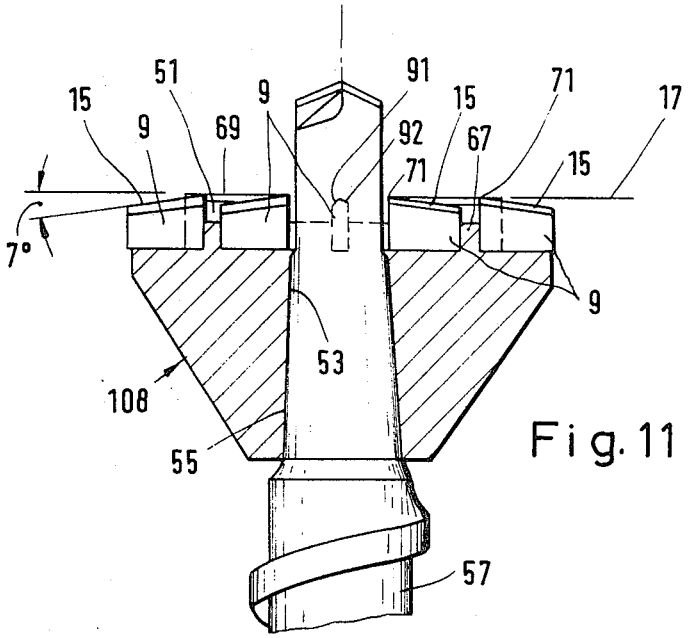
FIGS. 10 and 11 show a modification of the embodiment illustrated in FIGS. 8 and 9.
Figure 10:
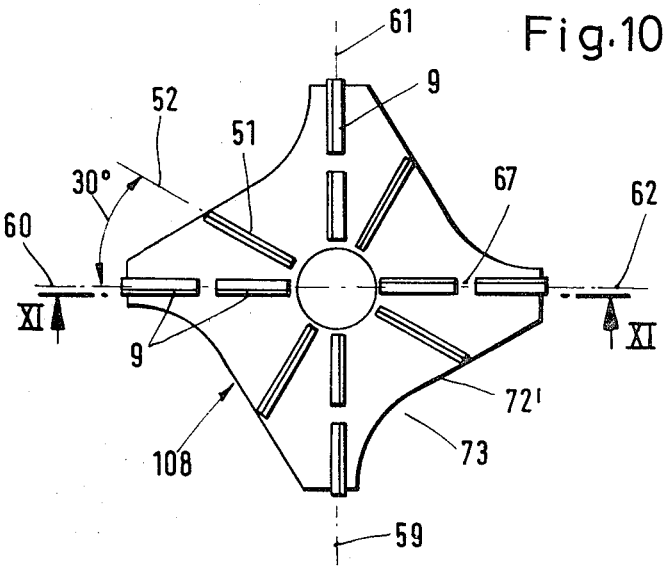

FIGS. 10 and 11 show a modified embodiment of the cutter head 107 illustrated in FIGS. 8 and 9. The main cutter head 108 shown in FIGS. 10 and 11 is provided with milling cutters 9 staggered in pairs along the radial cutter lines 59 to 62. The cutting edges 15 of the milling cutters slope outward, i.e., from inside to outside, away from plane 17. The cutting edges 69 of the intermediate hammering cutters 51 arranged on the intermediate radial cutter lines 52 again fall into the plane 17. The projecting tips 71 of the milling cutters 9 also fall into plane 17 as do also the projecting tips 71 of all of the milling cutters.

Figure 12:
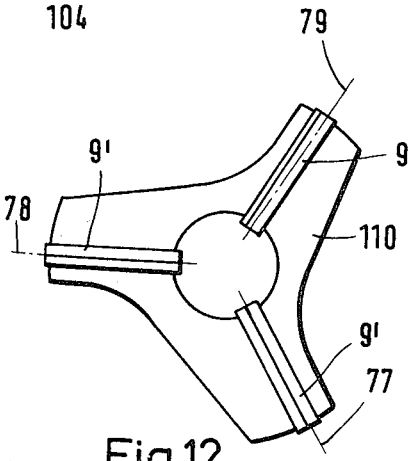
FIGS. 12 and 13 show two further variants of a cutter head having three cutter lines occupied by a mixture of hammering and milling cutters.
Figure 13:
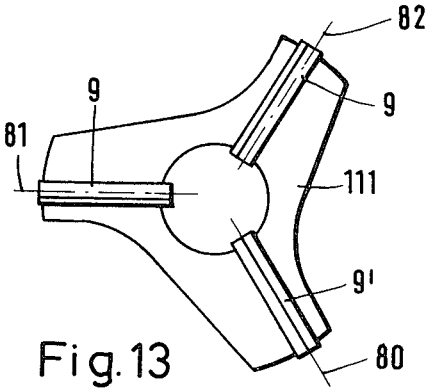

FIGS. 12 and 13 show two variants of the cutter head according to the invention with three cutter lines. The cutter heads 110 and 111 are primarily intended for small bore diameters. Whereas in the cutter head 100 shown in FIG. 12 two hammering cutters 9' are respectively arranged on two cutter lines 77 and 78 and the cutter line 79 is equipped with a milling cutter 9, the cutter head 111 in FIG. 13 has a hammering cutter 9' on only one cutter line 80, while the other two cutter lines 81 and 82 are equipped with milling cutters 9.

In the cutter heads having five cutter lines, the angular interval between the cutter lines amounts to 72°, whereas in cutter heads having four cutter lines it amounts to 90° and, in cutter heads having three cutter lines, to 120°.

Cutter heads of different diameter may be clamped onto the drill stems of all the arrangements illustrated. Similarly, a worn cutter head may readily be replaced by a new cutter head without the drill stem having to be renewed at the same time.

Figure 14:
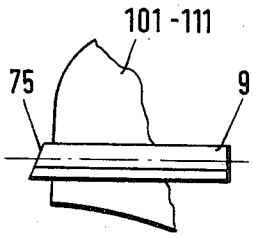
FIG. 14 shows an undercut.

It is of advantage for the outer edges of the cutters to project slightly beyond the cutter head and, in order to form a relief angle, to be additionally provided with an undercut 75, as indicated in FIG. 14. In addition, it can be seen from all the embodiments illustrated that the cutters all adjoin the fore-cutter at the center of the cutter head and, apart from gaps between the individual cutters, extend to the outer edge of the cutter head. The gaps between the individual cutters on one cutter line are bridged by a suitable arrangement of the cutters on adjacent radials or by the provision of intermediate cutters. This ensures that the entire area of rock to be drilled is always uniformly worked by alternate hammering and milling.

It has been found that the arrangement of milling and hammering cutters apparent from the illustrated embodiments is extremely suitable both for small boreholes and for large boreholes and provides for fast cutting rates with a relatively low power input. The undercuts known per se and the relatively deep recesses in the sides of the cutter head enable the cut rock material to be uniformly and cleanly removed.

Experience has shown that the combined use of hammering cutters and milling cutters stabilizes the direction of advance to a considerable extent.

The cutter head according to the invention has even proved to be suitable in cases where reinforcements have to be penetrated. Reinforcements can be cut through saitsfactorily together with the drilling of rock.

We claim:

1. A rotary percussion drill bit comprising a drill stem having a pilot cutter at one end thereof, and a detachable main cutter head surrounding said drill stem shank and set back from the leading edge of said pilot cutter, said cutter head comprising a plurality of main cutter elements having their cutting edges arranged along outwardly extending main radial cutter lines, characterized in that said main cutter head is provided with both milling and hammering/chipping cutters along each of said main radial cutter lines, said cutter elements are spaced along said radial cutter lines with small gaps between adjacent cutters the gaps between the cutters of one radial cutter line are bridged by cutters arranged along another radial cutter line following said one radial cutter line in the direction of rotation of the cutter head.

2. A cutter head as claimed in claim 1, characterized in that the cutting edges (11, 69) of the hammering/-chipping cutters (9') project approximately 1 to 3 mm beyond the tips (14, 71) of the milling cutters.

3. A cutter head as claimed in claim 1, characterized in that, in a construction having five cutter lines, a hammering/chipping cutter is followed, looking from inside to outside in the peripheral direction, by a milling cutter and by another hammering/chipping cutter on a first imaginary cutter line, in that the second line has two hammering/chipping cutters on the inside and one milling cutter on the outside, in that on the third line a hammering/chipping cutter is followed from inside to outside by a milling cutter and by another hammering/-chipping cutter, in that on the fourth cutter line a milling cutter is followed from inside to outside by two hammering/chipping cutters and in that finally, on the fifth cutter line two hammering/chipping cutters are followed from inside to outside by a milling cutter.

4. A rotary percussion drill bit as claimed in claim 1 wherein said drill stem is tapered to provide an outer frusto conical surface and said cutter head is provided with a matching inner frusto conical surface further characterized by a shoulder on said drill stem at the base of said outer frusto conical surface, said outer frusto conical surface having a larger base diameter than the base diameter of said inner frusto conical surface whereby a lateral space is left between said main cutter head and said shoulder of said drill stem when said main cutter head is mounted on said drill stem to accommodate an ejector.

5. A rotary percussion drill bit as claimed in claim 4 further characterized in that said drill stem terminates at said tapered portion as a flat end, and an axial frusto conical recess is contained within said tapered portion of said drill stem adapted to retain a separate pilot bit comprising a pilot cutter and a bit stem, said bit stem having a tapered outer frusto conical surface matching said frusto conical recess of said drill stem, and an enlarged body portion of greater diameter than the base of said frusto conical surface of said drill stem whereby a lateral space is provided between the end of said drill stem and said body portion of said pilot bit stem when said pilot bit is mounted in said drill stem to accommodate an ejector.

* * * * *